US011892229B2

(12) United States Patent
Katkar et al.

(10) Patent No.: US 11,892,229 B2
(45) Date of Patent: Feb. 6, 2024

(54) MODULAR STORAGE

(71) Applicant: WHIRLPOOL CORPORATION, Benton Harbor, MI (US)

(72) Inventors: Mansi Gajanan Katkar, Pune (IN); Omkar S. Mithari, Pune (IN); Vinay M. Patil, Pune (IN); Shrinivas V. Pawar, Pune (IN); Sanket Vivek Phalak, Pune (IN); Mohit Akhilesh Singh, Kalbadevi (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/677,284

(22) Filed: Feb. 22, 2022

(65) Prior Publication Data

US 2022/0268512 A1 Aug. 25, 2022

Related U.S. Application Data

(60) Provisional application No. 63/152,916, filed on Feb. 24, 2021.

(51) Int. Cl.
*F25D 25/02* (2006.01)
*A47B 57/06* (2006.01)
(Continued)

(52) U.S. Cl.
CPC ..... *F25D 25/02* (2013.01); *A47B 57/06* (2013.01); *A47B 96/025* (2013.01); *F25D 25/04* (2013.01)

(58) Field of Classification Search
CPC .. F25D 23/025; F25D 25/02; F25D 2325/021; F25D 23/04; F25D 25/027;
(Continued)

(56) References Cited

U.S. PATENT DOCUMENTS 97,489 A * 12/1869 Edson ..... B66B 9/025 108/147
3,885,846 A * 5/1975 Chuang ..... F25D 25/02 211/187
(Continued)

FOREIGN PATENT DOCUMENTS

CN 208154913 U 11/2018
CN 111481001 A 8/2020
(Continued)

OTHER PUBLICATIONS

Translation for CN208154913 (Year: 2018).*

*Primary Examiner* — Hiwot E Tefera
(74) *Attorney, Agent, or Firm* — Brooks Kushman, P.C.

(57) ABSTRACT

An adjustable refrigeration rack system may include a pair of parallel shafts arranged on a rear interior cabinet side of a refrigerator, a plurality of pairs of attachment mechanisms, each attachment mechanisms having one attachment mechanism arranged on one rail, and another arranged at equal height on the other rail, the attachment mechanisms configured to hold a shelf and selectively engage the respective shafts, and a drive mechanism configured to drive the shafts vertically, wherein movement of the shafts causes movement of the shelf arranged on the attachment mechanisms selectively engaged with the shafts, but not movement of a shelf arranged on the attachment mechanisms unattached to the shafts.

16 Claims, 19 Drawing Sheets

(51) Int. Cl.
*A47B 96/02* (2006.01)
*F25D 25/04* (2006.01)

(58) Field of Classification Search
CPC ..... F25D 23/067; F25D 25/04; F25D 23/065; F25D 2323/023; F25D 25/024; E05Y 2900/31; A47B 57/06; A47B 57/32; A47B 57/08; A47B 57/10; A47B 96/025
See application file for complete search history.

(56) References Cited

U.S. PATENT DOCUMENTS 3,982,801 A 9/1976 Heidorn et al.
5,199,778 A * 4/1993 Aoki ..... F25D 25/02 108/147
5,913,584 A * 6/1999 Swindell ..... F25D 25/02 248/292.12
6,085,542 A * 7/2000 Johnson ..... F25D 23/04 312/405
8,529,001 B2 * 9/2013 Calvillo ..... F25D 25/02 312/408
8,556,093 B2 * 10/2013 Davis ..... A47F 5/137 211/175
9,113,705 B1 * 8/2015 Jacob ..... F16H 19/04
10,334,948 B2 7/2019 Xiang et al.
10,561,233 B1 * 2/2020 Lin ..... A47B 9/12
10,694,843 B2 6/2020 Nuss
11,280,539 B2 * 3/2022 Kim ..... F25D 23/025
2009/0127993 A1 * 5/2009 Hrubesch ..... F25D 25/02 312/408
2009/0255292 A1 * 10/2009 Benz ..... A47B 57/06 700/275
2010/0176702 A1 * 7/2010 Kim ..... F25D 23/04 312/405.1
2019/0075924 A1 * 3/2019 Nuss ..... F25D 25/02

FOREIGN PATENT DOCUMENTS

DE 102011079196 A1 1/2013
WO 2018086503 A1 5/2018
WO 2018095731 A1 5/2018

* cited by examiner

MODULAR STORAGE

CROSS-REFERENCE TO RELATED APPLICATIONS

This application claims the benefit of U.S. provisional application Ser. No. 63/152,916 filed Feb. 24, 2021, the disclosure of which is hereby incorporated in its entirety by reference herein.

TECHNICAL FIELD

Disclosed herein are modular storage systems for appliances.

BACKGROUND

Household appliances, such as refrigerators, freezers, beverage coolers, etc., typically have multiple shelves to allow for food storage. These shelves may be removable and adjustable in height to allow a user to create a custom shelf arrangement within the appliance.

SUMMARY

An adjustable refrigeration rack system may include a pair of parallel shafts arranged on a rear interior cabinet side of a refrigerator, a plurality of pairs of attachment mechanisms, each attachment mechanisms having one attachment mechanism arranged on one rail, and another arranged at equal height on the other rail, the attachment mechanisms configured to hold a shelf and selectively engage the respective shafts, and a drive mechanism configured to drive the shafts vertically, wherein movement of the shafts causes movement of the shelf arranged on the attachment mechanisms selectively engaged with the shafts, but not movement of a shelf arranged on the attachment mechanisms unattached to the shafts.

In one example, the drive mechanism is configured to rotate the shafts, the shafts being threaded and configured to engage a shaft opening defined by the attachment mechanisms.

In another embodiment, each attachment mechanism includes a clamping mechanism having two halves, each of the halves defining half of the shaft opening and configured to engage the shaft when the halves are in an engaged state, and disengage the shaft when the halves are in a spaced disengaged state.

According to a further embodiment, at least one spring arranged between the halves and configured to bias the halves in the engaged state.

In one example, the clamping mechanism includes a rotatable cam arranged on a side of the halves and having a lever portion configured to push the halves apart, creating a gap between the halves to create the disengaged state.

In another embodiment, wherein the halves include vertically spaced bars along an outside of the halves opposite the side defining the shaft opening.

According to a further embodiment, a pair of shaft supports, one arranged on each side of the shaft and each shaft support, define a plurality of equidistantly spaced and sized perforations.

In one example, the bars are configured to selectively engage the perforations of the shaft supports when the attachment mechanism is in the disengaged state such that the shaft support supports the attachment mechanism.

In another embodiment, the drive mechanism includes a central gear arranged on a central shaft extending between the pair of parallel shafts and a worm gear arranged at each parallel shaft and fixed to the central shaft such that rotation of the central shaft activates each worm gear to rotate the parallel shafts.

According to a further embodiment, the drive mechanism includes a gear motor and wherein the central shaft is selectively rotated in each of the clockwise and counterclockwise directions by the gear motor.

An adjustable refrigeration rack system may include a pair of parallel shafts arranged on a rear interior cabinet side of a refrigerator, a plurality of attachment mechanisms, each attachment mechanism having one attachment mechanism to selectively engage a respective one of the parallel shafts and configured to hold a shelf and selectively engage the respective shafts, and a drive mechanism having a central gear arranged on a central shaft extending between the pair of parallel shafts and a worm gear arranged at each parallel shaft and fixed to the central shaft such that rotation of the central shaft activates each worm gear to rotate the parallel shafts, the drive mechanism configured to drive the shafts vertically, wherein movement of the shafts causes movement of the shelf arranged on the attachment mechanisms selectively engaged with the shafts.

In one example, the drive mechanism includes a gear motor and wherein the central shaft is selectively rotated in each of the clockwise and counterclockwise directions by the gear motor.

In another embodiment, the drive mechanism is configured to rotate the shafts, the shafts being threaded and configured to engage a shaft opening defined by the attachment mechanisms.

According to a further embodiment, the attachment mechanism is configured to causes movement of the shelf arranged on the attachment mechanism selectively in an engaged state with the shaft, but not movement of a shelf arranged on the attachment mechanism when in a disengages state with the shaft.

In one example, each attachment mechanism includes a clamping mechanism having two halves, each of the halves defining half of the shaft opening and configured to engage the shaft when the halves are in an engaged state, and disengage the shaft when the halves are in a spaced disengaged state.

In another embodiment, at least one spring is arranged between the halves and configured to bias the halves in the engaged state.

According to a further embodiment, the clamping mechanism includes a rotatable cam arranged on a side of the halves and having a lever portion configured to push the halves apart, creating a gap between the halves to create the disengaged state.

In one example, the halves include vertically spaced bars along an outside of the halves opposite the side defining the shaft opening.

In another embodiment, a pair of shaft supports, one arranged on each side of the shaft and each shaft support, defines a plurality of equidistantly spaced and sized perforations.

According to a further embodiment, the bars are configured to selectively engage the perforations of the shaft supports when the attachment mechanism is in the disengaged state such that the shaft support supports the attachment mechanism.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

In household appliances, such as refrigerators, freezers, etc., full height flexibility of the shelves is important to users. However, manually adjusting the shelves often requires removal of all of the items currently being stored on the shelf to be moved, as well as angling the shelf to remove it from a rail at the rear of the appliance.

Disclosed herein is a modular storage system designed to move shelves up and down without requiring the shelf to be emptied of all contents. That is, a fully loaded shelf may move vertically, saving the user time and effort. The shelf may be relocated at any vertical location within the cabinet of the appliance, allowing for flexible storage space for the user. Two or more rails may be arranged at the back interior side of the cabinet. The shelf may have arms on opposite sides, where the rails are configured to receive the two ends of the shelf side arms. The rail engages with a slider or attachment mechanism that includes an engagement mechanism configured to selectively engage and disengage a shaft arranged parallel to the respective rail. The slider may be moved by a motor and controlled by a single button, or via control at a mobile app.

Figure 1:
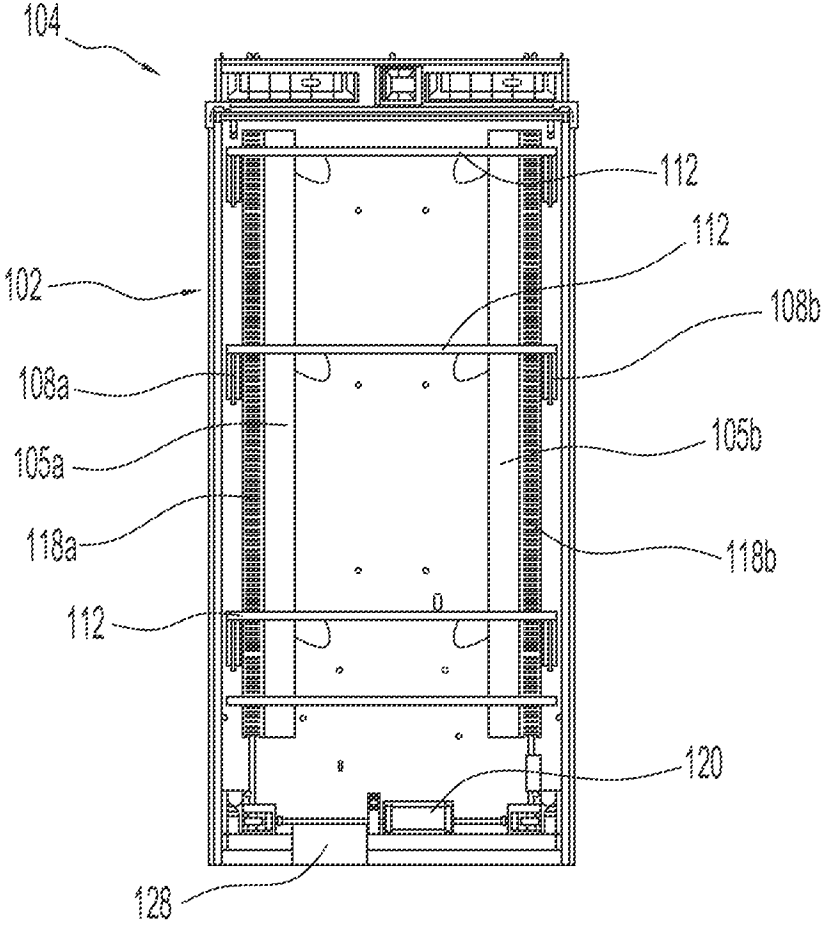
FIG. 1 illustrates a front view of a household appliance having modular storage system.

FIG. 1 illustrates a front view of a household appliance 102 having modular storage system 104 including a pair of parallel shaft mechanisms 105 (individually referred to as first shaft mechanism 105*a* and second shaft mechanism 105*b*) arranged on a rear interior cabin side of the appliance 102. Although not shown in FIG. 1, the shaft mechanism 105 includes a shaft 106 (first shaft 106*a* and second shaft 106*b*). The example appliance 102 herein is illustrated as a refrigerator, but it is to be understood that other appliances 102 may benefit from the modular storage system 104. The modular storage system 104 may include a plurality of shelves 112 each including an arm or bracket at each end thereof. Each arm is attached to at least one attachment mechanism 108 such that each shelf 112 includes at least one pair of attachment mechanisms 108 where a first attachment mechanism 108*a* is arranged at one shaft 106*a*, and another attachment mechanism 108*b* is arranged at equal height on the other shaft 106*b*.

The shelves 112 are held in place on one of two parallel rails 118, including a first rail 118*a* and a second rail 118*b*. The rails 118 may include a ladder-like formation where consistently spaced openings in the rails 118 are configured to receive prongs from the arms of the shelves 112 in order to maintain the shelves 112 at a fixed and stable position within the cabinet of the appliance 102. The rails 118 are attached to the shaft mechanism 105, which is configured to selectively engage with the attachment mechanism 108.

Figure 11:
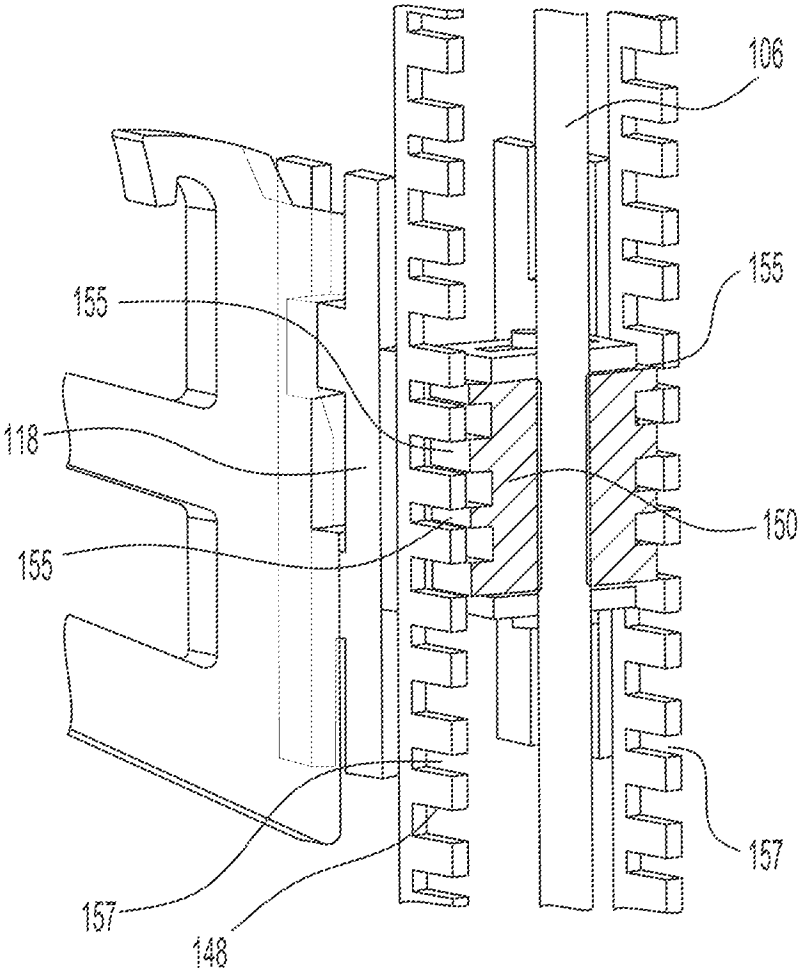
FIG. 11 illustrates the clamping mechanism of the attachment mechanism in a clamped state relative to the shaft.
Figure 13:
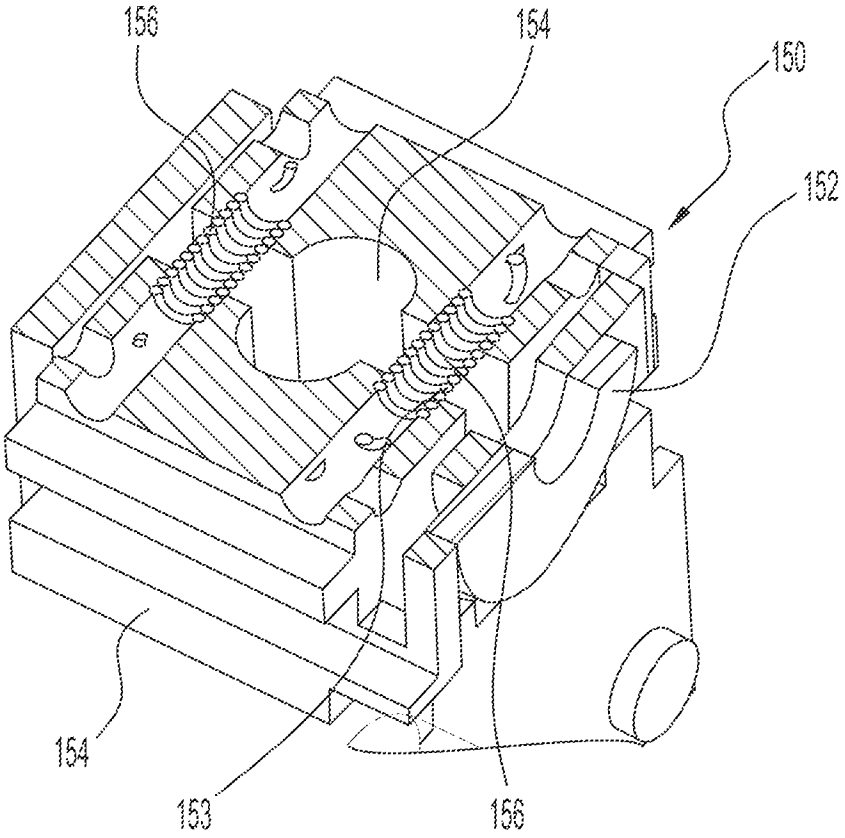
FIG. 13 illustrates the clamping mechanism of the attachment mechanism in an un-clamped state.

The attachment mechanism 108 may selectively engage the shaft mechanism 105 (specifically a shaft support 148 as best illustrated in FIGS. 11 and 13). Alternatively, the attachment mechanism 108 may selectively engage the shaft 106 when the shelf 112 is to move vertically. The shaft 106 may be threaded and the attachment mechanism 108 may engage the threads of the shaft 106. The shaft 106 may be referred to herein as a lead screw. Once the attachment mechanism 108 is secured to the shaft 106, the shaft 106 may rotate in a first direction to drive the attachment mechanism 108 upward. Conversely, the shaft 106 may rotate in an opposite second direction to drive the attachment mechanism 108 downward. A drive mechanism 120 may be configured to rotate the shafts 106.

The modular storage system 104 may include a controller 128 to control the components herein such as motors, gears, sensors, etc. The controller 128 may include the machine controller and any additional controllers provided for controlling any of the components of the appliance 102. For example, the controller 128 can include the machine controller and a motor controller. Many known types of controllers can be used for the controller 128. It is contemplated that the controller 128 is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the appliance 102. The controller 128 may also include or be coupled to a memory configured to include instructions and databases to carry out the systems and processes disclosed herein.

The controller 128 may receive data and commands from the system components and may also have an antenna for wireless communication with the devices within the appliance 102, as well as device remote from the appliance 102. In one example, the controller 128 may receive commands from switches on or within the appliance 102 to move the shelves 112. Additionally or alternatively, the controller 128 may receive commands from a mobile application on device remote from the appliance 102.

Figure 2A:
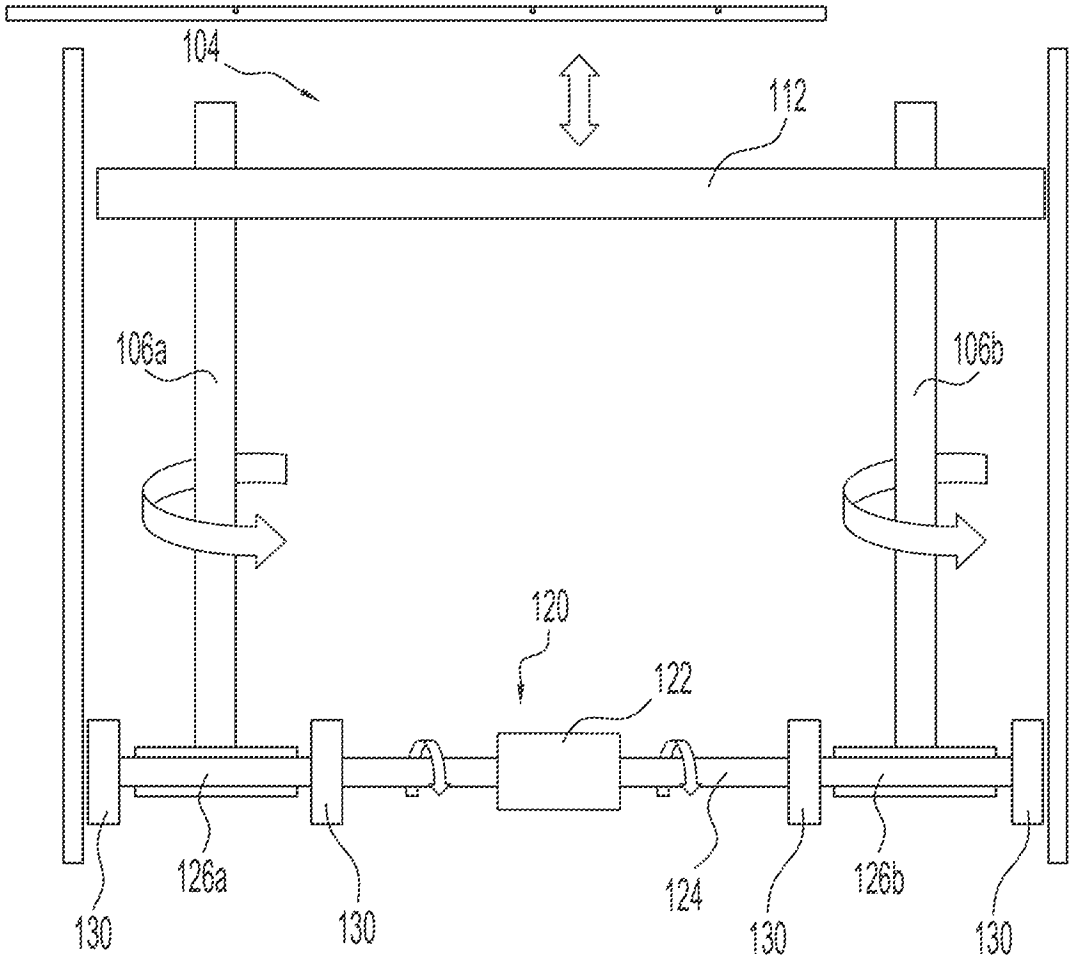
FIG. 2A illustrates a front schematic view of the modular storage system.
Figure 2B:
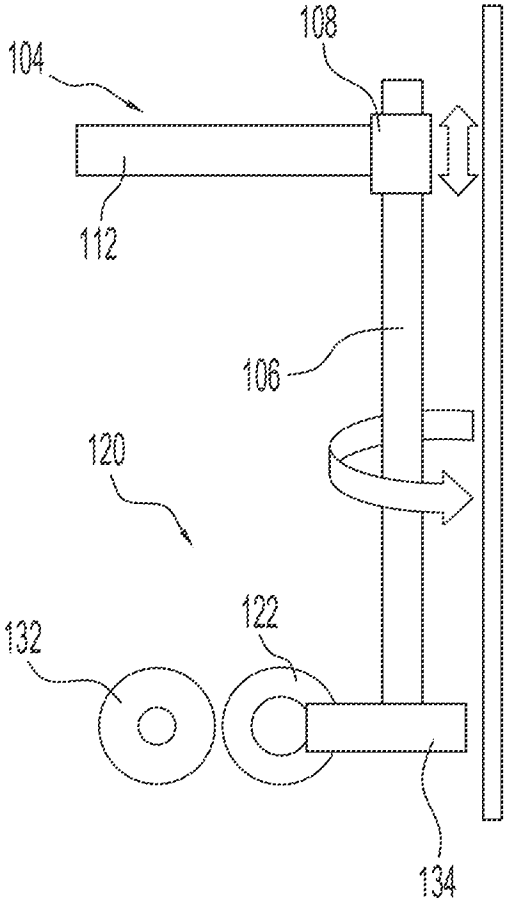
FIG. 2B illustrates a side schematic view of the modular storage system.
Figure 3:
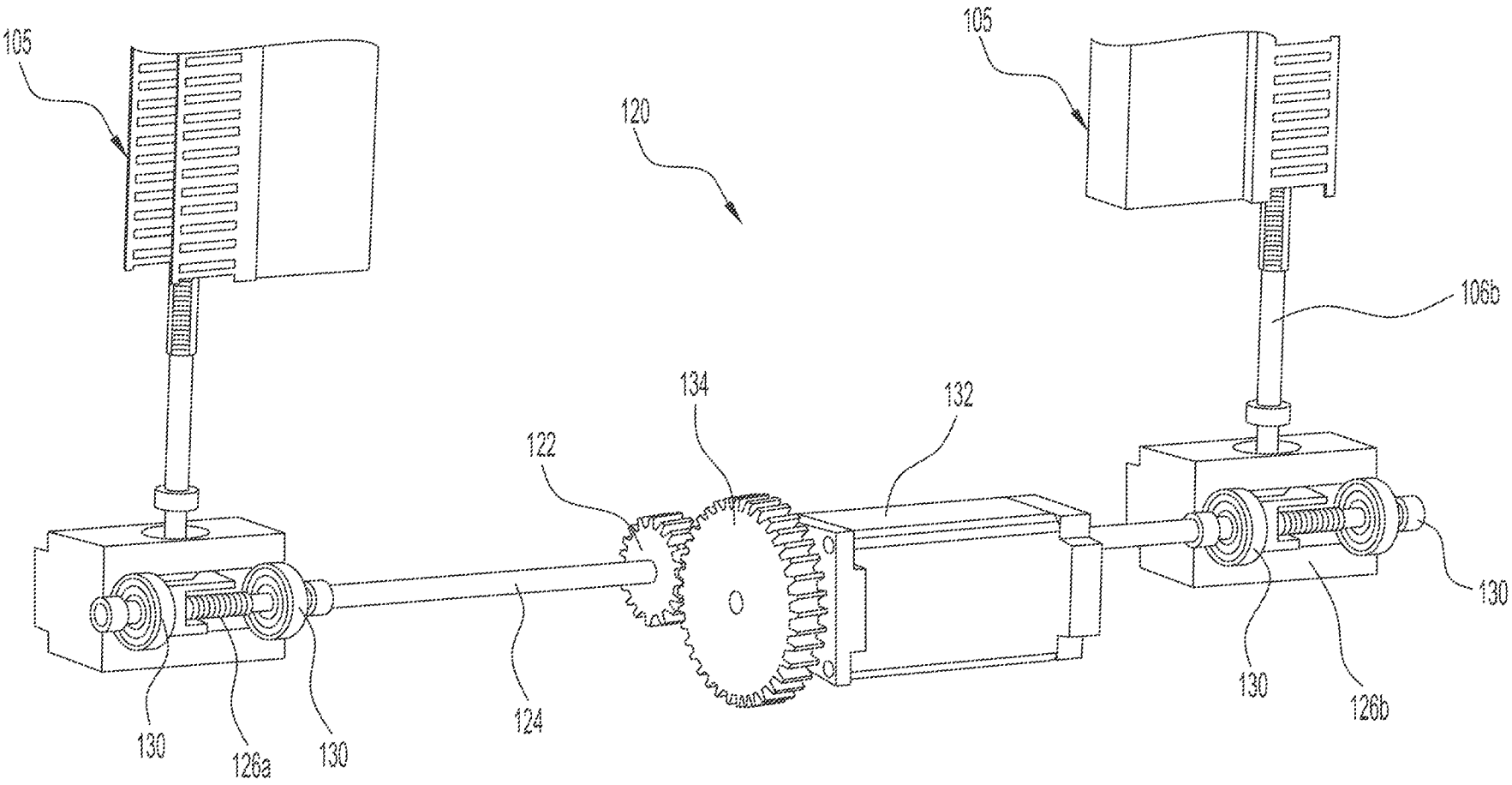
FIG. 3 illustrates a perspective view of the drive mechanism of the modular storage system.
Figure 4:
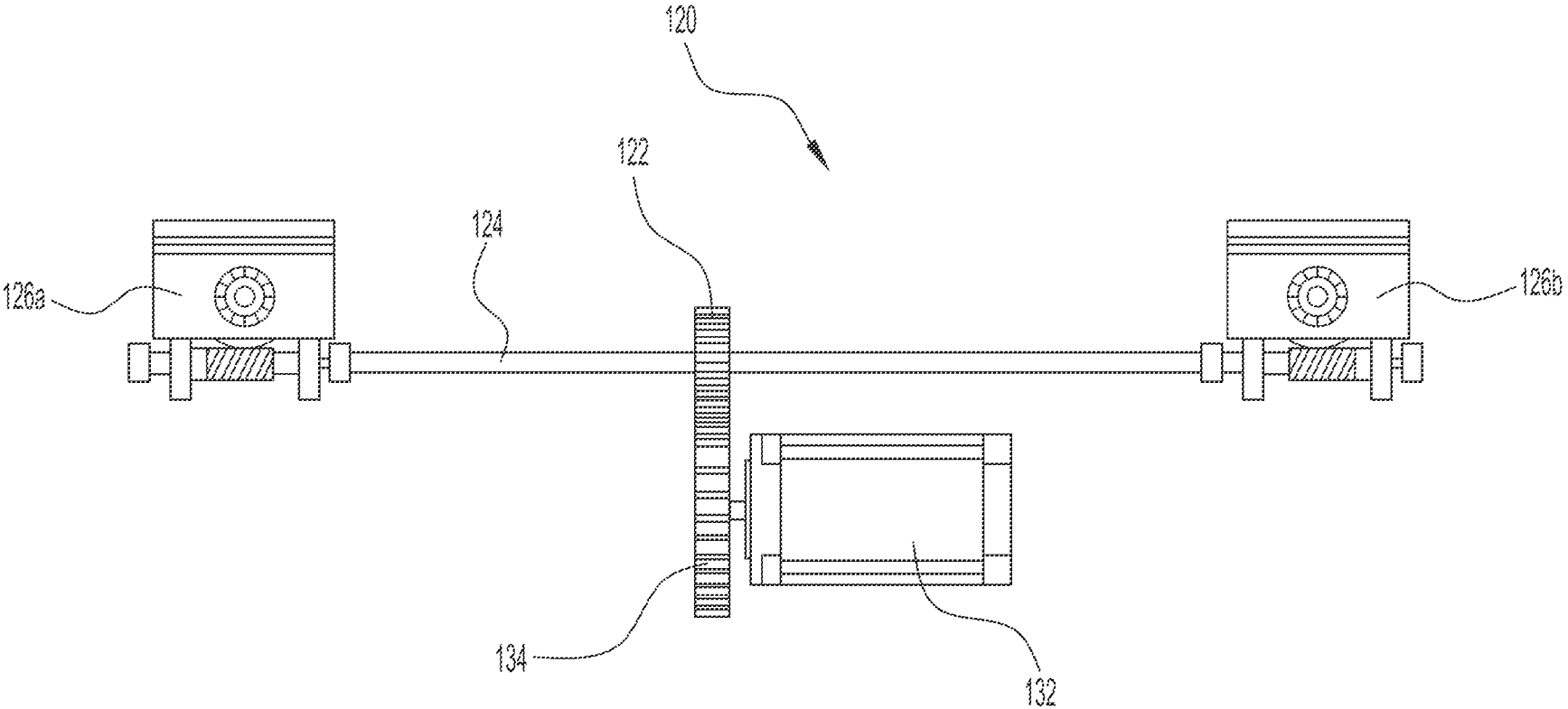
FIG. 4 illustrates a front view of the drive mechanism of the modular storage system of FIG. 3.

FIGS. 2A and 2B illustrate schematic views of the modular storage system 104. FIGS. 3 and 4 illustrate additional views of the drive mechanism 120. The drive mechanism 120 may include a central gear 122 on a central shaft 124 connected to two worm gears 126. Each of the worm gears 126 (e.g., worm gear 126*a* and worm gear 126*b*) may be associated with a respective shaft 106. A pair of bearings 130 may be arranged on each side of the worm gear 126. A gear motor 132 may drive a wheel 134 that then rotates the shaft 124 via the central gear 122. The shaft 124 may then activate and rotate the worm gears 126, which in turn rotate the shafts 106.

Figure 5:
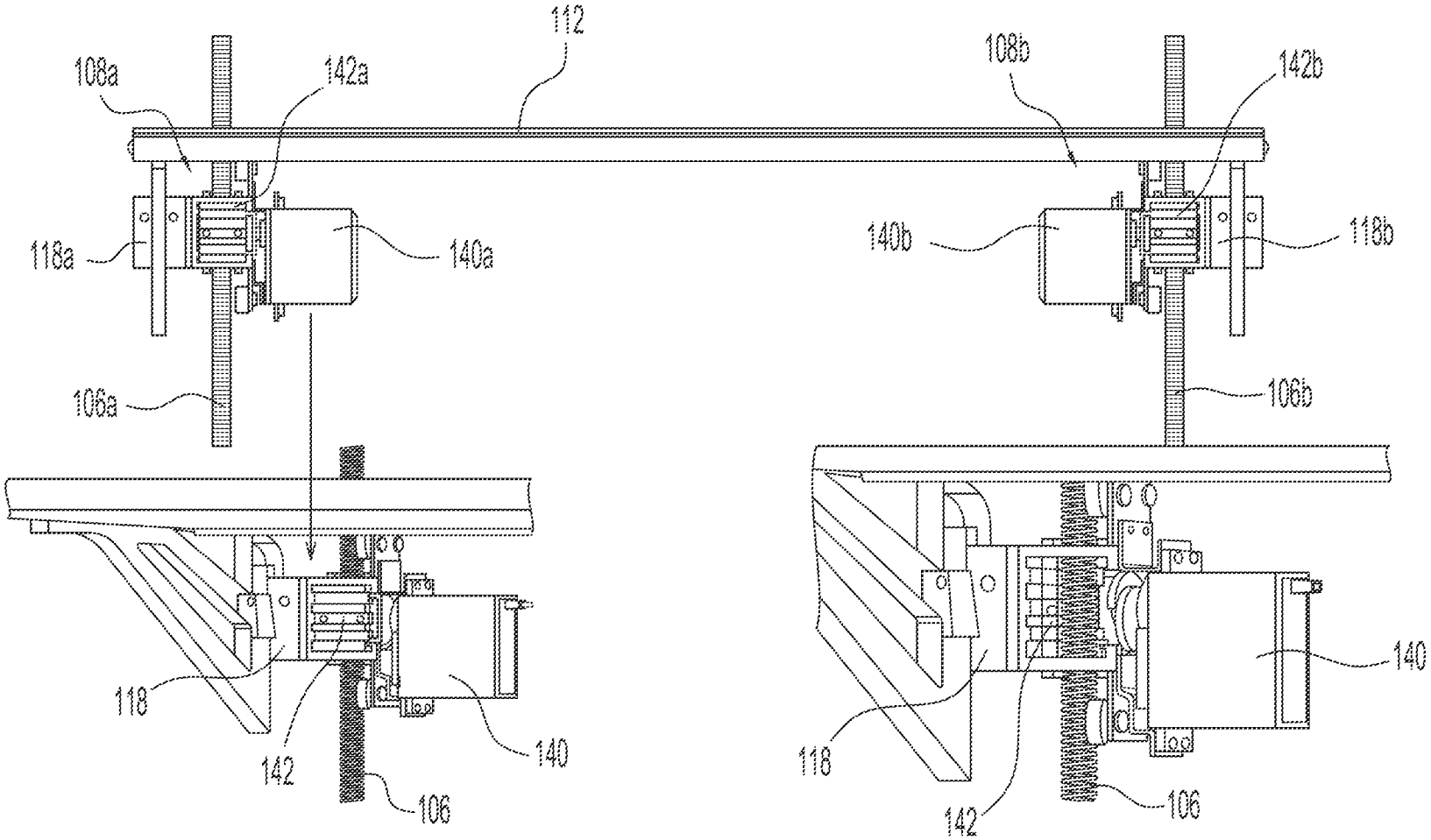
FIG. 5 illustrates a front view of the shelf, rod, and attachment mechanism of the modular storage system.

FIG. 5 illustrates an example view of the attachment mechanism 108. The attachment mechanism 108 includes a motor 140 and an engagement portion 142. The motor 140 may drive the engagement portion 142 between an engaged state and a disengaged state. In the engaged state, or attached state, the engagement portion 142 may be fixed to the shaft 106. In this state, if the shaft 106 rotates, the attachment mechanism 108 may move vertically with the shaft 106. In the disengaged state, the engagement portion 142 is not fixed to the shaft 106 and remains in place. In the event the shaft 106 rotates, the attachment mechanism 108 may not engage the shaft 106 and thus remain at its fixed position in the appliance 102.

Figure 6:
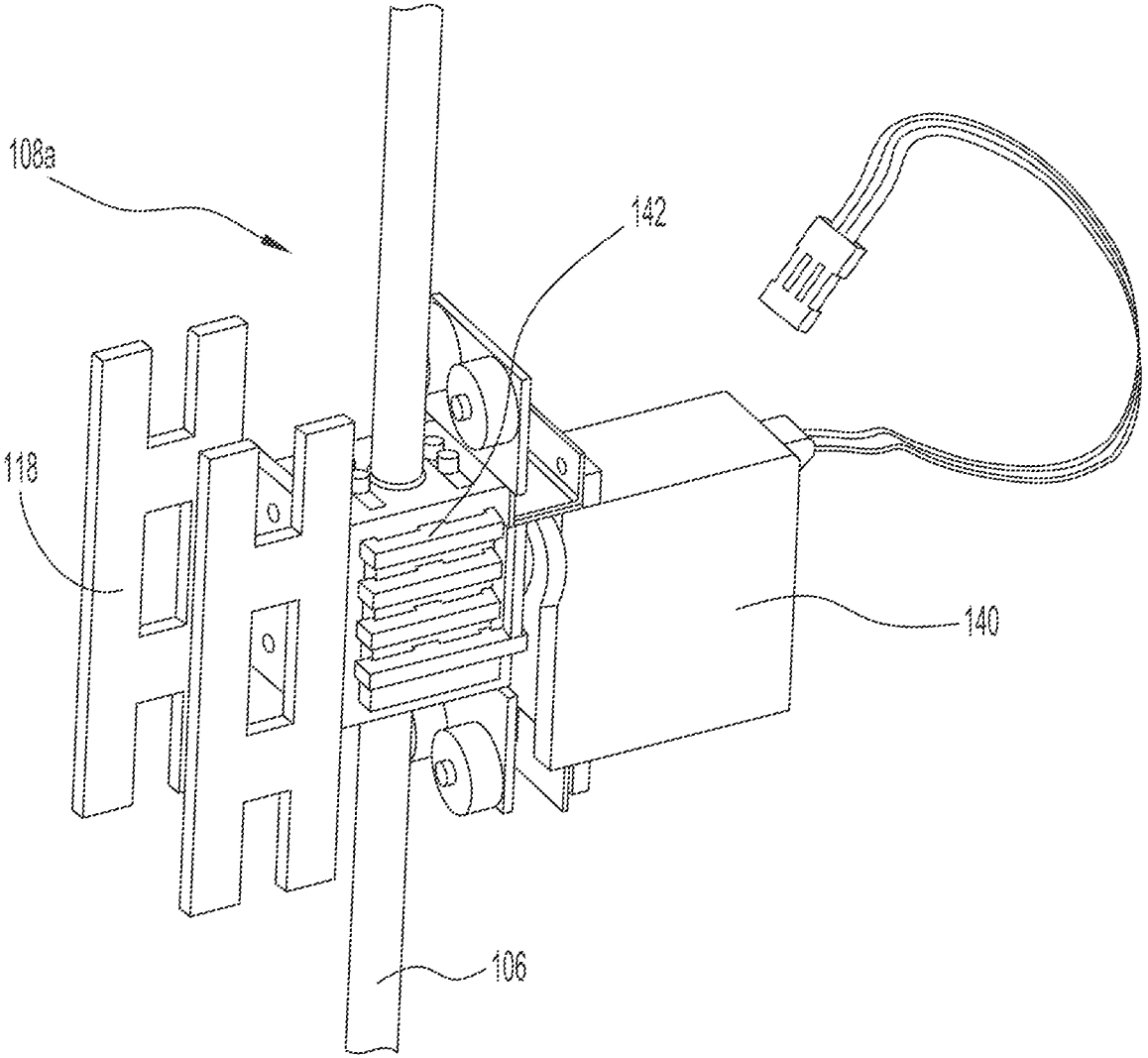
FIG. 6 illustrates perspective view of the attachment mechanism on the shaft.
Figure 7:
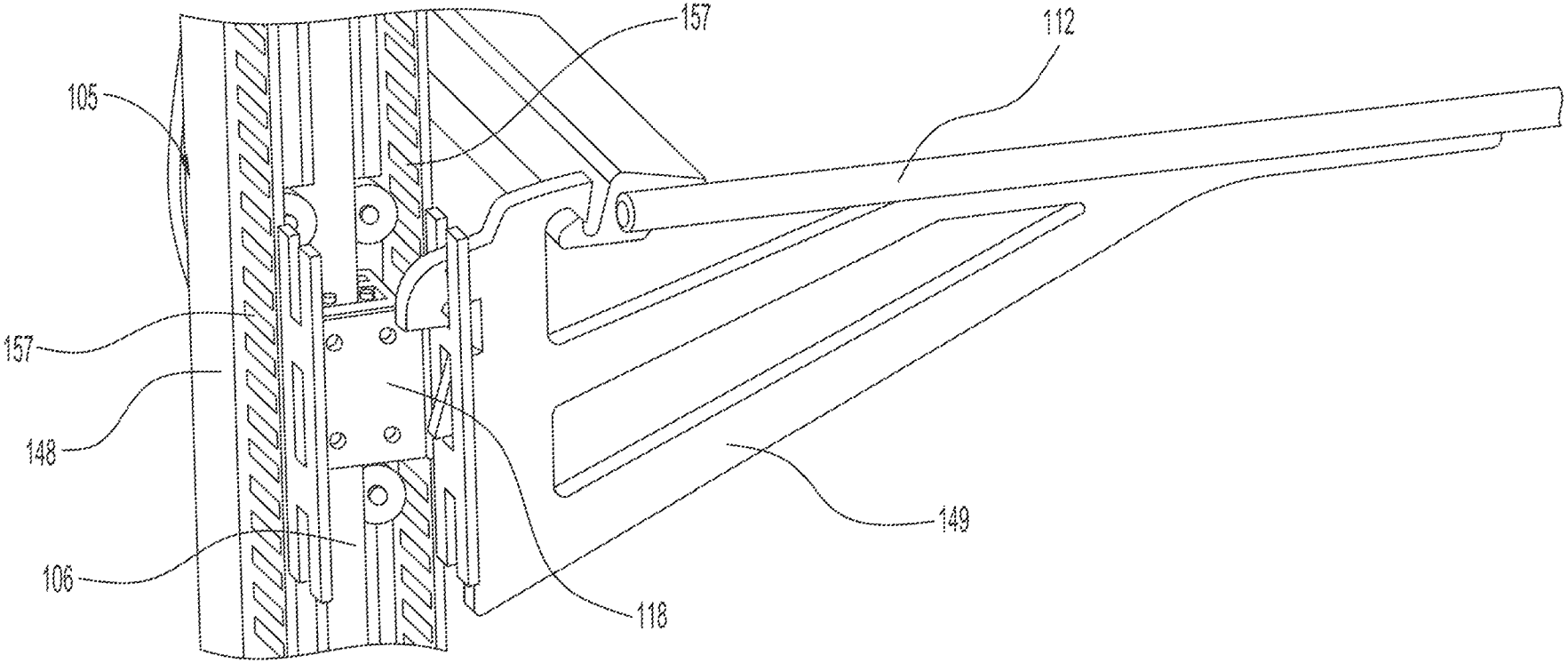
FIG. 7 illustrates a perspective view of the attachment mechanism on the shaft surrounded by the shaft support and the shelf.

FIG. 6 illustrates an example view of the attachment mechanism 108 on the shaft 106. FIG. 7 illustrates an example view of the attachment mechanism 108 on the shaft 106 surrounded by the shaft support 148 and the shelf 112. The shelf 112 is retained on the rail 118 by a bracket 149.

Figure 12:
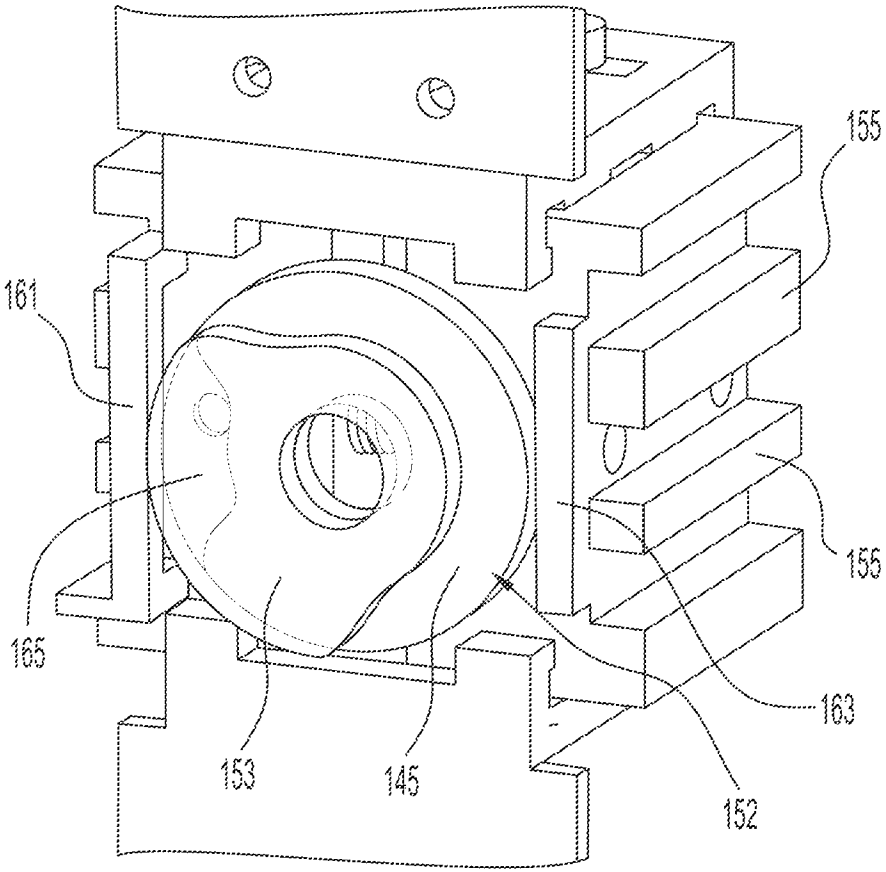
FIG. 12 illustrates the engagement portion of the attachment mechanism in an disengaged state.
Figure 14:
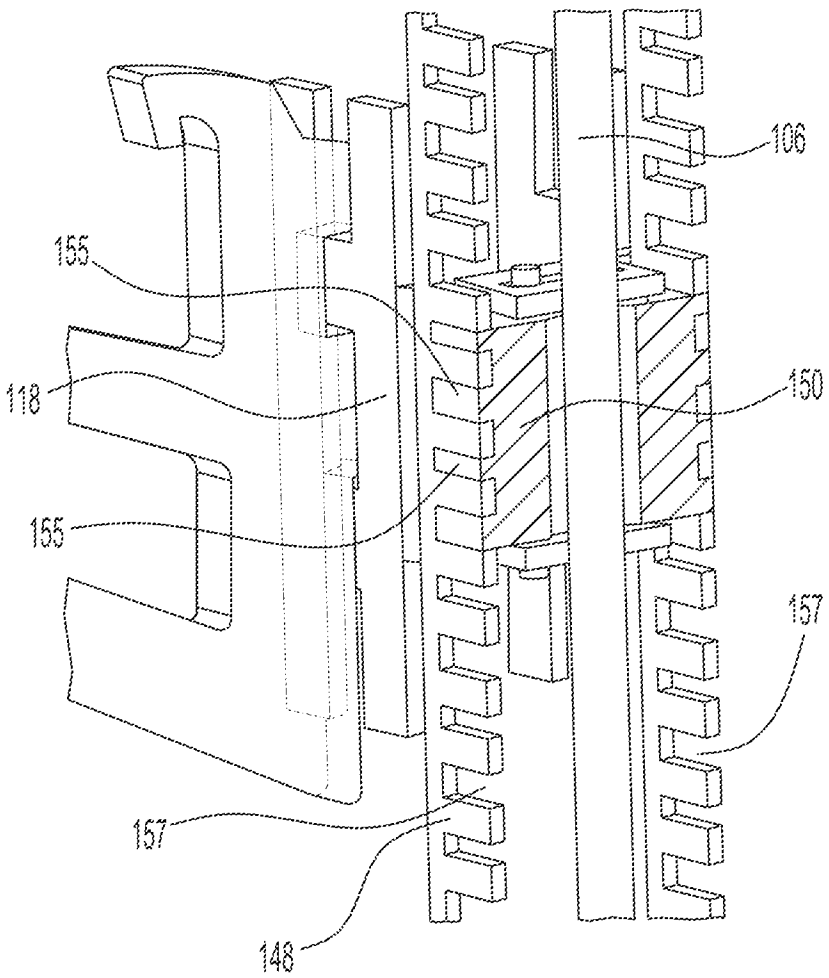
FIG. 14 illustrates the clamping mechanism of the attachment mechanism in an unclamped state relative to the shaft.

The shaft support 148 may define a plurality of perforations 157 configured to selectively receive portions of a clamping mechanism 150 when the clamping mechanism 150 is in an unclamped state, as illustrated best in FIGS. 12-14. The perforations 157 may be equally sized and spaced to allow selective engagement along the shaft support 148.

Figure 8A:
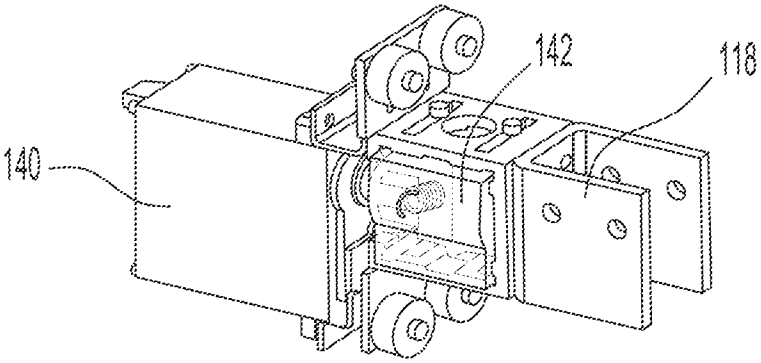
FIG. 8A illustrates a perspective view of the attachment mechanism.
Figure 8B:
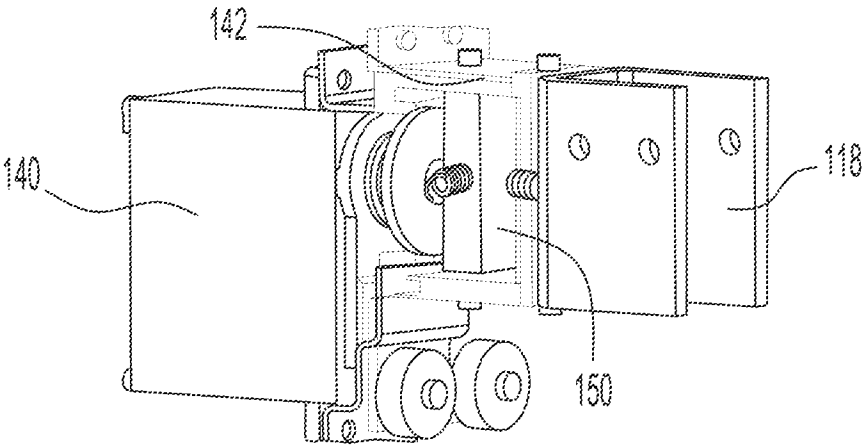
FIG. 8B illustrates a perspective view of a portion of a clamping mechanism of the attachment mechanism.
Figure 8C:
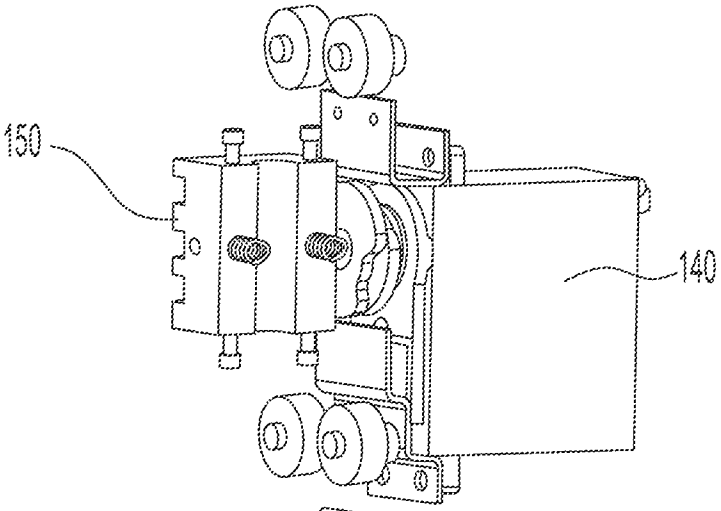
FIG. 8C illustrates a further portion of the clamping mechanism of the attachment mechanism.
Figure 8D:
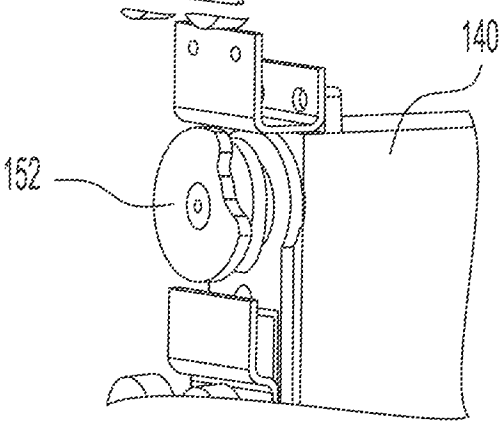
FIG. 8D illustrates a cam mechanism of the attachment mechanism.

FIGS. 8A-D illustrates a series of cut-away views of the attachment mechanism 108. For example, FIG. 8B illustrates a portion of a clamping mechanism 150 within the engagement portion 142. FIG. 8C illustrates a portion of the clamping mechanism 150. FIG. 8D illustrates a cam mechanism 152.

Figure 9:
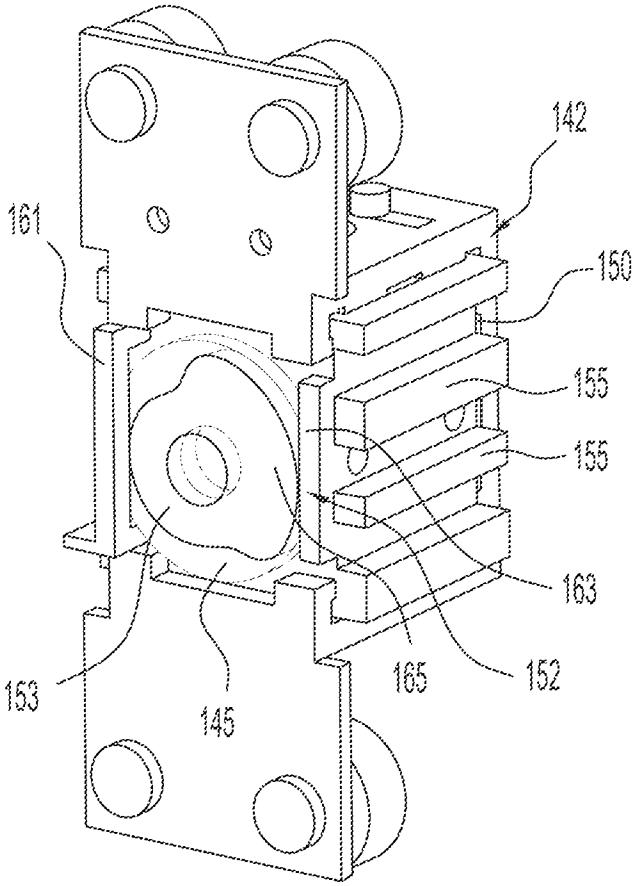
FIG. 9 illustrates the engagement portion of the attachment mechanism in an engaged stated.
Figure 10:
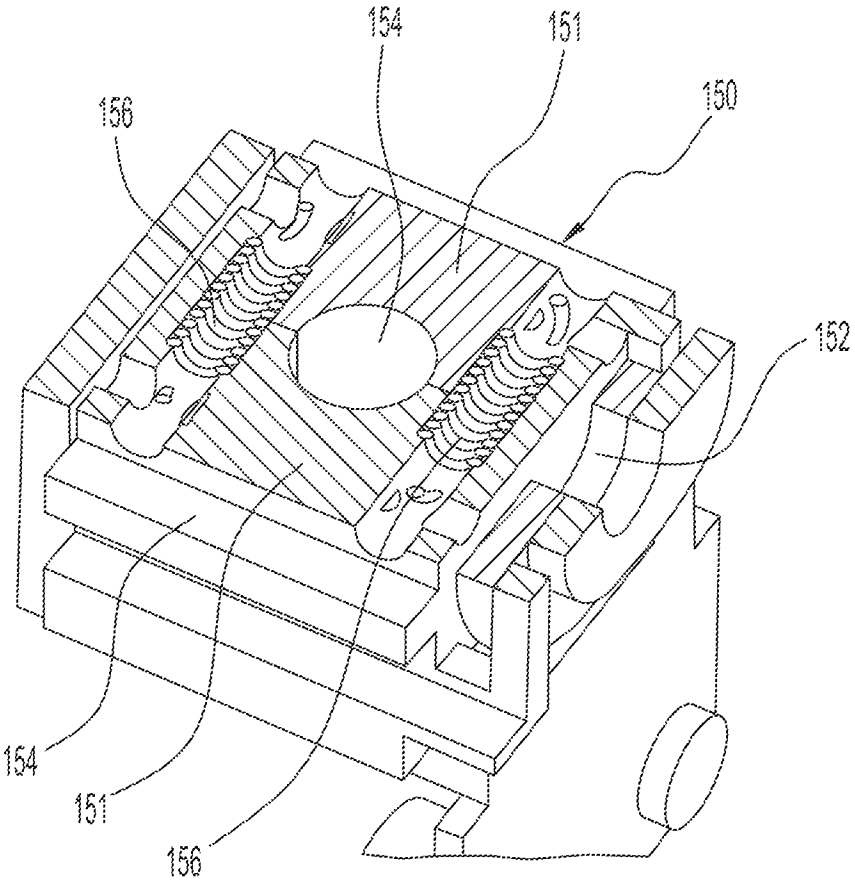
FIG. 10 illustrates the clamping mechanism of the attachment mechanism in a clamped position.

FIG. 9 illustrates the engagement portion 142 in an engaged state. FIG. 10 illustrates the clamping mechanism 150 in a clamped position. FIG. 11 illustrates the clamping mechanism 150 in a clamped state relative to the shaft 106. FIG. 12 illustrates the engagement portion 142 in a disengaged state. FIG. 13 illustrates the clamping mechanism 150 in an un-clamped state. FIG. 14 illustrates the clamping mechanism 150 in an unclamped state relative to the shaft 106. FIGS. 9, 10, 12 and 13 do not show the shaft 106 to better emphasize the clamping mechanism 150 in the various states.

As best illustrated in FIG. 10, the clamping mechanism 150 may include two halves 151, each defining openings at the interior facing sides of the half 151 to define a shaft opening 154, as best shown in FIG. 10. The shaft opening 154 is configured to receive the shaft 106 (not illustrated). In the engaged or clamped state, the halves 151 may close together. The halves 151 may each define half 151 of the shaft opening 154. The shaft opening 154 may close around and engage the shaft 106 and a threaded portion of the shaft opening 154 may engage with the threads of the shaft 106. The engagement portion 142 may then move upon rotation of the shaft 106. The halves 151 may be maintained together via a pair of springs 156 configured to create tension between the halves 151 to force the halves together.

Referring to FIGS. 12-14, the engagement portion 142 is in the disengaged state and the clamping mechanism 150 is in an unclamped state. This state may be the normal state for the attachment mechanism 108 as it allows the shelf 112 to remain stationary within the appliance 102 regardless of whether the shaft 106 is rotating. In this unclamped state, the clamping portion halves may be separated, creating a space therebetween. As shown in FIG. 14, the halves are spaced around the shaft 106.

The halves 151 of the clamping mechanism 150 may each define a vertical wall adjacent to the cam mechanism 152 such that a first wall 161 on one half 151 is parallel to a second wall 163 on the other half 151. The cam mechanism 152 may include a washer 145 and a cam 153 arranged thereon. The cam mechanism 152 may be centered between the two walls 161, 163. One of the walls 161, 163 may extend from the clamping mechanism 150 further than the other. The washer 145 may be arranged within the walls 161, 163. The cam 153, which includes a lever portion, may be collinear with at least one of the walls 161, 163, but not with the other. In the example shown in FIGS. 9 and 12, the first wall 161 extends further from the clamping mechanism 150 than the second wall 163.

The motor 140 may rotate the cam 153. When a lever portion 165 of the cam 153 extends toward the second wall 163, the lever portion 165 may extend over the wall 163, as shown in FIG. 9, until the lever portion 165 of the cam 153 engages the first wall 161. When the lever portion 165 of the cam 153 comes into contact with the first wall 161, the lever portion 165 may abut the wall 161 and push the respective half 151 away from the other half 151. This causes a gap between the halves 151, allowing the clamping mechanism 150 to disengage from the shaft 106 and engage with the shaft support 148, as best shown in FIG. 14. The cam 153 may exert enough force to overcome the biasing force of the springs 156.

As best illustrated in FIGS. 9 and 11 and 12 and 14, each half 151 of the clamping mechanism 150 may include a plurality of vertically spaced bars 155 along the outer side of the wall 161. The bars 155 are arranged opposite the side of the half 151 that defines the shaft opening 154. The bars 155 may be dimensioned to be received by the perforations 157 of the shaft support 148. In an engaged state, as shown in FIGS. 9-11, the bars 155 may not engage the perforations 157 as the halves 151 are biased together to engage the shaft 124. However, in a disengaged state, the halves 151 are forced apart to release the shaft 106 and engage the perforations 157.

Referring back to FIGS. 9-11, in response to a signal indicating the desire to move a specific shelf 112, the motor 140 may rotate the cam mechanism 152 so that the lever portion 165 of the cam 153 is no longer abutting the first wall 161 of the clamping mechanism 150, but instead is arranged over the second wall 163. As explained, the springs 156 may create tension and pull the two halves together in order to allow the clamping mechanisms 150 to engage with the threaded shaft 106.

The engagement portion 142 may include bearings, rollers, supports, etc., to aid in sustaining the engagement portion 142 within the shaft support 148 and on the shaft 106. Moreover, in the disengaged stated, the clamping mechanism 150 may engage with the shaft support 148 to maintain the shelf 112 thereon. Thus, in the engaged state, the attachment mechanism 108 is engaged with the shaft 106. In the disengaged state, the attachment mechanism 108 is locked and resting on the shaft support 148. FIG. 14 illustrates the example cam mechanism 152.

Figure 15:
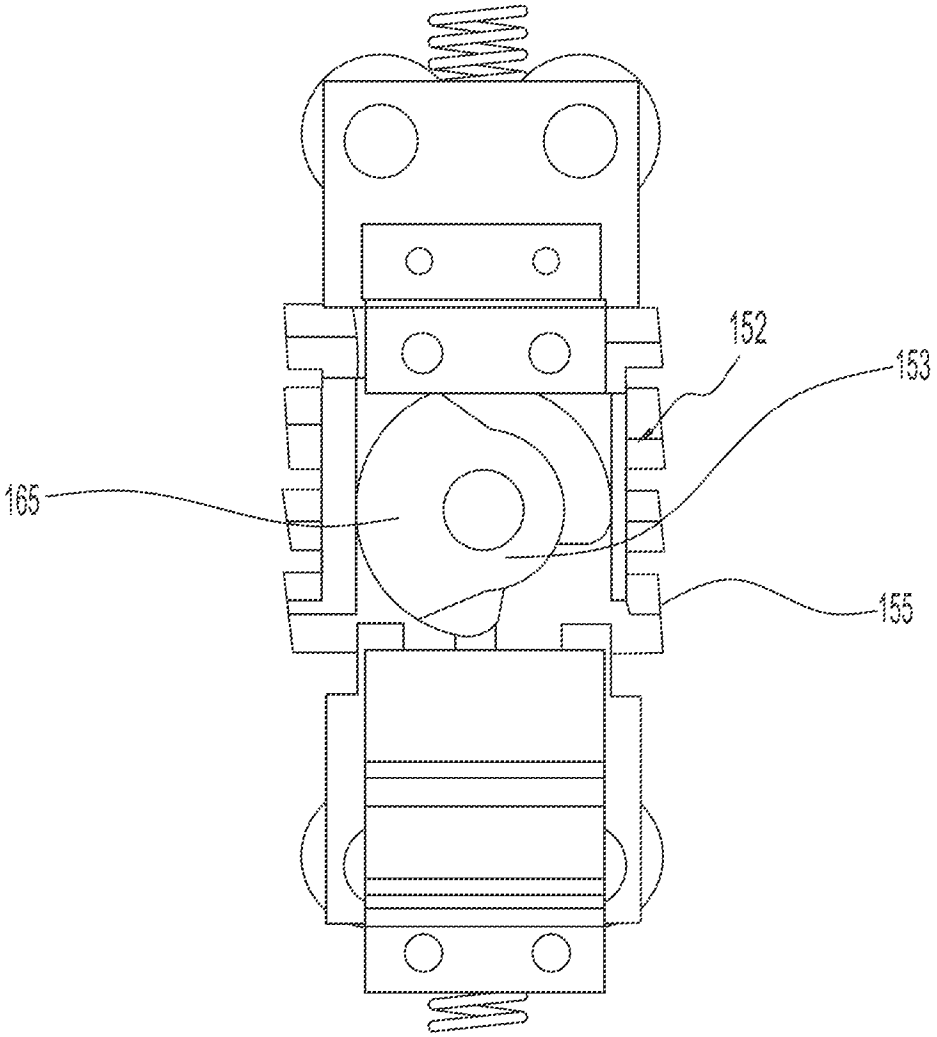
FIG. 15 illustrates a front view of the cam of the clamping mechanism.

FIG. 15 illustrates a front view of the cam mechanism 152 of the clamping mechanism 150. As explained above, the motor 140 (not shown in FIG. 15) may rotate the cam 153. When the lever portion 165 of the cam mechanism 152 comes into contact with the first wall 161, the lever portion 165 may abut the wall 161 and push the respective half 151 away from the other half 151. This causes a gap between the halves 151, allowing the clamping mechanism 150 to disengage from the shaft 106 and engage with the shaft support 148. The springs 156 (not shown in FIG. 15) bias the halves 151 into the engaged state when the cam 153 is not forcing the halves apart.

Figure 16:
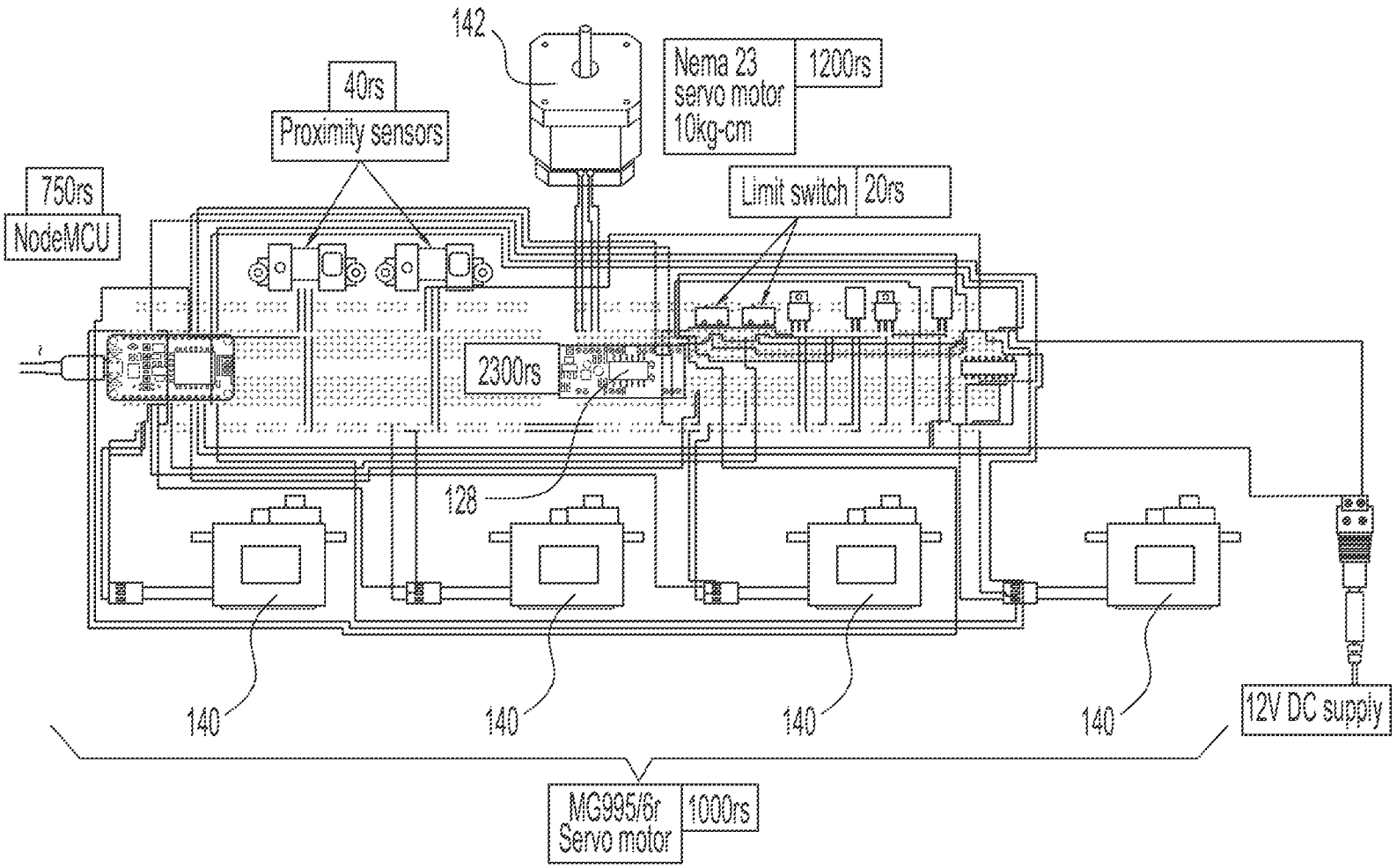
FIG. 16 illustrates an example schematic of the modular storage system.
Figure 17:
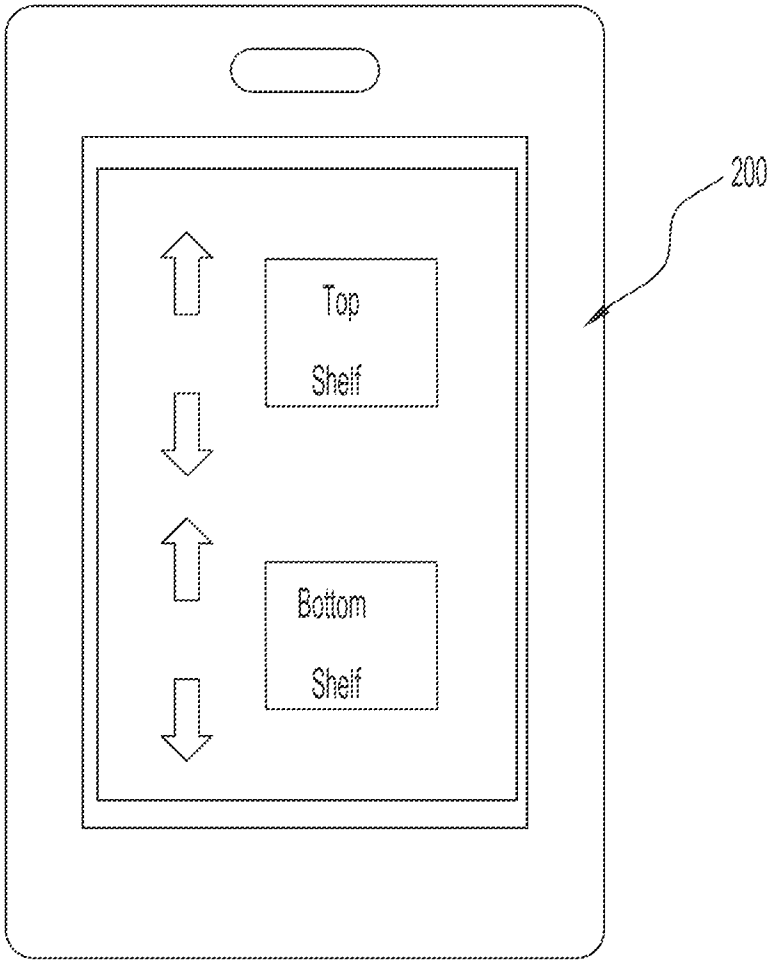
FIG. 17 illustrates an example mobile device having a mobile application installed thereon to control the modular storage system.

FIG. 16 illustrates an example schematic of the modular storage system 104 including motors 140, the controller 128, drive motor of the drive mechanism 120, as well as sensors, switches, power supplies, etc. FIG. 17 illustrates an example mobile device 200 having a mobile application installed thereon to control the modular storage system 104. The mobile application may present a user interface configured to present information to the user, as well as receive user feedback and commands as to desired control of the shelves 112 within the appliance 102. For example, the user may select to adjust the height of one or more shelves 112 by selecting the respective arrow and direction within the mobile application.

The mobile device 200, which may be any device such as a cellular phone, tablet, personal computer, etc., may communicate with the controller 128 of the appliance 102 via a wireless network. Upon receiving instructions from the mobile device 200 via the application, the controller 128 may instruct various components of the modular storage system 104. These instructions may include instructions to the motors 140, attachment mechanisms 108, as well as the drive mechanism 120. In one example, should the user select to increase the height of the bottom shelf 112, the controller 128 may instruct the motors 140 of the attachment mechanism 108 of the bottom shelf 112 to rotate the cams 153 and, such that the clamping mechanism 150 moves to a clamped position. Once the attachment mechanism 108 is in an engaged state, the controller 128 may instruct the drive mechanism 120 to rotate the shafts 106. The shelf 112 may then move upwards as the shaft 106 rotates in the first direction. Once the shelf 112 reaches its desired position, which may be indicated via sensors, the controller 128 may instruct the drive mechanism 120 to cease rotation of the shaft 106 and for the motors 140 of the attachment mechanism 108 to rotate the cam 153 so that the attachment mechanism 108 may disengage the shaft 106 and engaged with the shaft support 148.

The modular storage system 104 may also be controlled by switches arranged either inside or outside of the appliance 102 such that actuation of a switch in a certain direction may indicate the movement of that switch. The user may move a switch corresponding to a respective shelf 112 in an upward position to move the shelf 112 up. Once the shelf 112 reaches its desired location, the user may move the switch to a neutral position. Conversely, the user may move the switch downward to move the shelf 112 down. The shelves 112 may be moved up and down when fully loaded, thus allowing the user to easily customize storage without having to unload items from the appliance 102.

Figure 19:
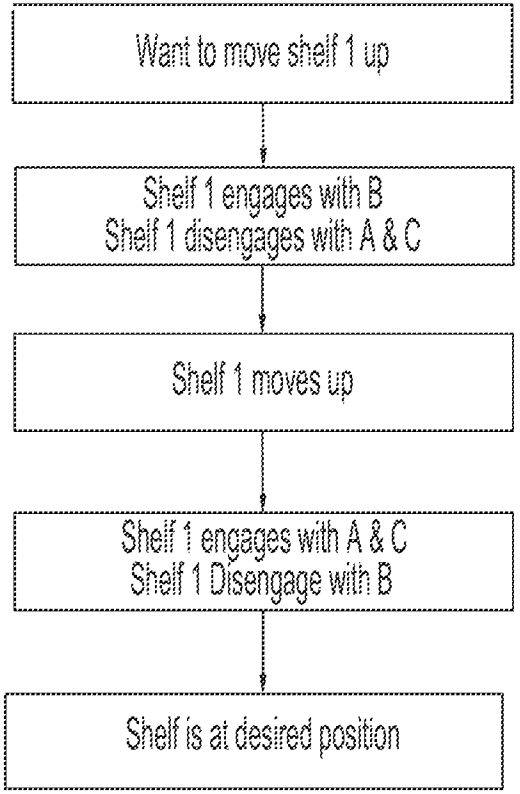
FIG. 19 illustrates an example flow chart for FIG. 17.
Figure 18:
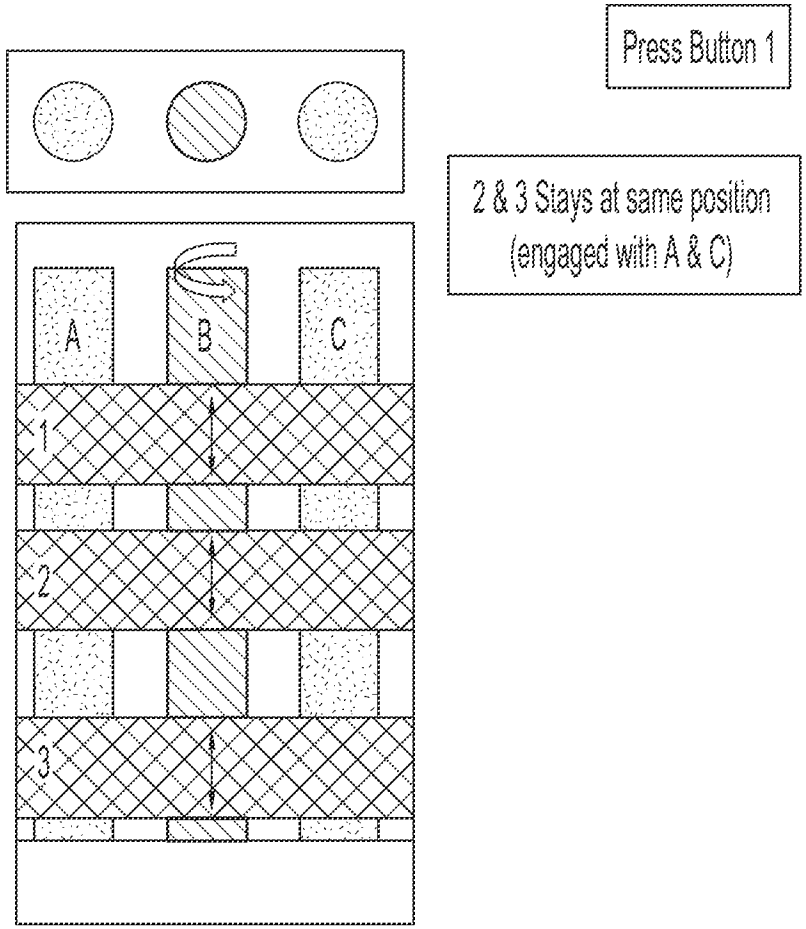
FIG. 18 illustrates an example block diagram of the modular storage system.

FIG. 18 illustrates an example block diagram of the modular storage system 104. FIG. 19 illustrates an example flow chart for FIG. 18. The systems disclosed herein allow the user the freedom of organizing items within a refrigerator with minimum loss of usable space due to the flexibility and ease of use. As explained, the shelf 112 may be mounted on the side arms at two ends, which are then attached to a slider with the help of a linkage. The slider consists of an engagement/disengagement mechanism, when the specific shelf 112 is to be moved up/down the slider gets engaged on the screw and once the shelf 112 is moved to the required level it gets disengaged from the screw and gets locked on the ladder. Both screws are connected to a worm and wheel gearbox individually, the worm gears 126 of both screws are mounted on the same shaft 124 which is driven by a motor 140 located in the center of the cabinet.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

The flowcharts and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An adjustable refrigeration rack system, comprising:

a pair of parallel shafts arranged on a rear interior cabinet side of a refrigerator;

a plurality of pairs of attachment mechanisms, each attachment mechanisms having one attachment mechanism arranged on one rail, and another arranged at equal height on the other rail, the attachment mechanisms configured to hold a shelf and selectively engage the respective shafts, wherein each attachment mechanism includes a clamping mechanism having two halves, each defining half of a shaft opening and configured to engage the shaft when the halves are in an engaged state, and disengage when the halves are in a disengaged state, wherein each of the halves of the clamping mechanism define a wall opposite the wall of the other of the halves, the clamping mechanism including a rotatable cam arranged between the walls on a side of the halves and having a lever portion configured to selectively apply pressure to at least one of the walls to push the halves apart, creating a gap between the halves to create the disengaged state; and a drive mechanism configured to drive the shafts vertically when the clamping mechanism is in the disengaged state, wherein movement of the shafts causes movement of the shelf arranged on the attachment mechanisms selectively engaged with the shafts, but not movement of a shelf arranged on the attachment mechanisms unattached to the shafts.

2. The system of claim 1, wherein the drive mechanism is configured to rotate the shafts, the shafts being threaded and configured to engage the shaft opening defined by the attachment mechanisms.

3. The system of claim 1, at least one spring arranged between the halves and configured to bias the halves in the engaged state.

4. The system of claim 1, wherein the halves include vertically spaced bars along an outside of the halves opposite the side defining the shaft opening.

5. The system of claim 4, further comprising a pair of shaft supports, one arranged on each side of the shaft and each shaft support defining a plurality of equidistantly spaced and sized perforations.

6. The system of claim 5, wherein the bars are configured to selectively engage the perforations of the shaft supports when the attachment mechanism is in the disengaged state such that the shaft support supports the attachment mechanism.

7. The system of claim 2, wherein the drive mechanism includes a central gear arranged on a central shaft extending between the pair of parallel shafts and a worm gear arranged at each parallel shaft and fixed to the central shaft such that rotation of the central shaft activates each worm gear to rotate the parallel shafts.

8. The system of claim 7, wherein the drive mechanism includes a gear motor and wherein the central shaft is selectively rotated in each of the clockwise and counterclockwise directions by the gear motor.

9. An adjustable refrigeration rack system, comprising:

a pair of parallel shafts arranged on a rear interior cabinet side of a refrigerator;

a plurality of attachment mechanisms, each attachment mechanism having one attachment mechanism to selectively engage a respective one of the parallel shafts and configured to hold a shelf and selectively engage the respective shafts, wherein each attachment mechanism includes a clamping mechanism having two halves, each defining half of a shaft opening and configured to engage the shaft when the halves are in an engaged state, and disengage when the halves are in a disengaged state, wherein each of the halves of the clamping mechanism define a wall opposite the wall of the other of the halves, the clamping mechanism including a rotatable cam arranged between the walls on a side of the halves and having a lever portion configured to selectively apply pressure to at least one of the walls to push the halves apart, creating a gap between the halves to create the disengaged state; and a drive mechanism having a central gear arranged on a central shaft extending between the pair of parallel shafts and a worm gear arranged at each parallel shaft and fixed to the central shaft such that rotation of the central shaft activates each worm gear to rotate the parallel shafts, the drive mechanism configured to drive the shafts vertically when the clamping mechanism is in the disengaged state, wherein movement of the shafts causes movement of the shelf arranged on the attachment mechanisms selectively engaged with the shafts.

10. The system of claim 9, wherein the drive mechanism includes a gear motor and wherein the central shaft is selectively rotated in each of the clockwise and counterclockwise directions by the gear motor.

11. The system of claim 9, wherein the drive mechanism is configured to rotate the shafts, the shafts being threaded and configured to engage the shaft opening defined by the attachment mechanisms.

12. The system of claim 11, wherein the attachment mechanism is configured to causes movement of the shelf arranged on the attachment mechanism selectively in an engaged state with the shaft, but not movement of a shelf arranged on the attachment mechanism when in the disengaged state with the shaft.

13. The system of claim 9 at least one spring arranged between the halves and configured to bias the halves in the engaged state.

14. The system of claim 13, wherein the halves include vertically spaced bars along an outside of the halves opposite the side defining the shaft opening.

15. The system of claim 14, further comprising a pair of shaft supports, one arranged on each side of the shaft and each shaft support defining a plurality of equidistantly spaced and sized perforations.

16. The system of claim 15, wherein the bars are configured to selectively engage the perforations of the shaft supports when the attachment mechanism is in the disengaged state such that the shaft support supports the attachment mechanism.

* * * * *